United States Patent [19]

Iwamoto

[11] 4,362,099

[45] Dec. 7, 1982

[54] ADJUSTING DEVICE FOR SHEET REVERSING IN A SHEET-FED ROTARY PRESS

[75] Inventor: Masayuki Iwamoto, Shizuoka, Japan

[73] Assignee: Kabushiki Kaisha Shinoharatekkosho, Naganuma, Japan

[21] Appl. No.: 255,324

[22] Filed: Apr. 17, 1981

[30] Foreign Application Priority Data

May 2, 1980 [DE] Fed. Rep. of Germany ..... 3017013

[51] Int. Cl.[3] ..... B41F 21/04; B41F 21/10; B65H 5/12; B65H 29/06

[52] U.S. Cl. ..... 101/230; 101/411

[58] Field of Search ..... 101/230, 231, 409, 410, 101/411; 271/82, 277, 275, 204, 206

[56] References Cited

U.S. PATENT DOCUMENTS 4,122,773 10/1978 Wirz ..... 101/230

*Primary Examiner*—J. Reed Fisher

*Attorney, Agent, or Firm*—C. O. Marshall, Jr.

[57] ABSTRACT

An adjusting device for sheet reversing in a sheet-fed rotary press comprises a reversing cylinder which is driven by a drive shaft and carries a plurality of sheet grippers, a rotary drum carrying a plurality of leading-end grippers, a rotary assembly carrying a plurality of trailing-end grippers, which is concentric with said drum, a flange fixed to said drive shaft, a first drive gear fixed to said flange, a second drive gear which is adjustably attached to said flange and has a driving connection with said rotary assembly, a third drive gear which is adjustably attached to said flange and has a driving connection with said rotary drum, and means for manually rotating said reversing drive cylinder through said first gear, for selectively adjusting the angular position of attachment of the second and third gears to said flange.

4 Claims, 5 Drawing Figures

ADJUSTING DEVICE FOR SHEET REVERSING IN A SHEET-FED ROTARY PRESS

This invention relates to an adjusting device for making proper adjustment corresponding to switching of the dual mechanism for one-side multi-colour printing and both-side printing and/or change in size of the printing sheet in a sheet-fed rotary press.

In the case of one-side multi-colour printing in a sheet-fed rotary press, it is possible to adjust the timing of printing of each printing unit by properly setting the printing starting points of the respective printing units in conformity to the leading end of the sheet being printed as the leading end of the sheet is held by the grippers of each sheet feeding cylinder for feeding of the sheet from the first to second printing unit, from the second to third printing unit and from the third to fourth printing unit. Also, there is required no specific adjusting means for change of size of the sheet being printed because the leading end of the sheet is always positioned forwardly in the direction of movement of the printing sheet. However, in the case of both-side printing in the conventional sheet-fed rotary press, when the sheet P being printed is transferred from the double-sized drum cylinder $T_2$ to the next reversing cylinder $T_3$ (see FIGS. 1 and 2 of the accompanying drawings), not the leading end of the sheet P but the trailing end thereof is gripped, so that the grippers 8 holding the leading end of the sheet P on the double-sized drum cylinder $T_2$ will not transfer the sheet at the sheet transfer point B to the reversing cylinder $T_3$ but keep holding the sheet. The grippers 51 of the reversing cylinder $T_3$ catch the trailing end of the printing sheet P held by the trailing end grippers 12, 13 of the double-sized drum cylinder $T_2$ at the sheet transfer point B, while the grippers 8 holding the leading end of the sheet P on the cylinder $T_2$, release it allowing the sheet to be moved backwards by the reversing cylinder $T_3$ and be passed to the impression cylinder of the next printing unit II. In this case, therefore, there is required adjustment in accordance with the size of the sheet P. In other words, it is required to shift the relative phase of the first and second printing units I and II correspondingly to the size of the sheet being printed. One of the conventional adjusting methods in case of switching from one-side printing to both-side printing, or vice versa, is as follows. When the grippers 51 of the reversing cylinder $T_3$ are moved around through an angle of about 180°, since they do not meet the trailing end grippers 12, 13 of the double-sized drum cylinder $T_2$ ( a difference in the angle of $\theta_1$ in FIG. 3 is produced), the grippers 12, 13 of the double-sized drum cylinder $T_2$ are separated by loosening the fastening bolts which secure the grippers 12, 13 to the drive gear assembly, and then the reversing cylinder $T_3$ is turned and set to the predetermined position and again bolted to the position. For this purpose, arrangment is made such that the drive gear assembly of the trailing end grippers 12, 13 can be adjusted by means of elongated slots. Thereafter, in order to adjust to the size of the sheet P, the drive gear assembly of the reversing cylinder $T_3$ is turned so that the cylinder $T_3$ and the trailing end grippers 12, 13 of the double-sized drum cylinder $T_2$ will be allowed to move synchronously with each other. Thus, this system has an advantage that synchronization between the reversing cylinder $T_3$ and the trailing end grippers 12, 13 of the double-sized drum cylinder T2 is maintained, but because of one-side driving of the linking mechanism, irregularity tends to occur in the arrangements, and also it is required to provide stopper means on the trailing end gripper side for positioning the trailing end grippers 12,13 at a location where they cause no impropriety to the maximal sheet size in the case of one-side printing. If the stopper means should contact with the main shaft or the leading end gripper (8) side, driving force will be transmitted to the trailing end grippers 12, 13 from both drive shaft of the double-sized cylinder, T2 and driving gear thereof, so that it is instructed to provide a slight space for the stopper means. Thus, because the location for making adjustment relating to reversing of the grippers 51 of the reversing cylinder T3 and the location for adjustment conforming to size change of the sheet P are fairly distant from each other, the operator is obliged to perform inconsistent operations. Adjustment also needs to be made of stopper spacing at the central part of the double-sized drum cylinder T2 in its axial direction.

In another sheet-fed rotary press, adjustment corresponding to reversing of the grippers 51 of the reversing cylinder T3 in association with the trailing end grippers 12, 13 of the double-sized drum cylinder T2 tends to be attended by an error from registering of the markings provided on the driving gear assembly of the reversing cylinder T3. Also, adjustment conforming to size change of the sheet P must be made by first clamping the trailing end grippers 12, 13 of the double-sized drum cylinder T2 from the machine side wall by another locking means after loosening the driving gear assembly of the reversing cylinder T3 and then adjusting the phase of the first printing unit I side to the predetermined sheet size.

Therefore, in this case, too, the adjusting locations are distant from each other and hence the working efficiency is poor. Also, if locking of the double-sized drum cylinder T2 is insufficient, the gripping tolerance of the sheet P received by the grippers 51 of the reversing cylinder T3 may be varied.

The object of this invention is to provide a sheet reversion adjusting device for a sheet-fed rotary press according to which the relative positions of the respective leading and trailing end grippers of the double-sized drum cylinder at the time of switching of the reversing grippers of the reversing cylinder from one-side printing to both-side printing, or vice versa, as well as the predetermined positions of the trailing end grippers of said cylinder at the time of one-side printing can be surely and correctly set.

As used hereinafter, the term "drive gear" is intended to include not only a gear meshingly engaged or engageable with another gear for transmitting drive thereto, but also a sprocket wheel engaged or engageable with another sprocket wheel via a chain for transmitting the drive thereto.

According to the invention there is provided an adjusting device for sheet reversing in a sheet-fed rotary press having a double-sized drum cylinder equipped with sheet leading end grippers and sheet trailing end grippers angularly adjustable in the drum cylinder and a reversing cylinder angularly adjustable with respect to the drum cylinder and equipped with sheet grippers, the device comprising a flange drivingly engaged with a main shaft of the reversing cylinder, a first drive gear fixedly attached to the flange and drivingly engaged with a succeeding printing unit, a second drive gear adjustably attached to the flange and drivingly engaged with the trailing end grippers, a third drive gear adjustably attached to the flange and drivingly engaged with a main shaft of drum cylinder, and means for rotating the flange for adjusting the angular position of attachment of the second and third drive gears to the flange.

In a preferred embodiment the relative positions of the leading and trailing end grippers and the predetermined position of the trailing end grippers for one-side printing can be set by means of positioning pins. The reversing grippers and trailing end grippers of the double-sized drum cylinder are linked to each other through a series of gears and adjusting gear assembly. There takes place no deviation from the relative positions of both said grippers even in the event of a misoperation during adjustment in correspondence to size change of the printing sheet. Further, since the operating means for switching from one-side printing to both-side printing, or vice versa, are concentrated on the driving gears and flange thereof, the operator can make proper adjustment at one position with no need of repeating standing and sitting for the machine operation.

To help understanding of the invention a specific embodiment thereof will now be described by way of example with reference to the accompanying drawings in which.

Figure 3:
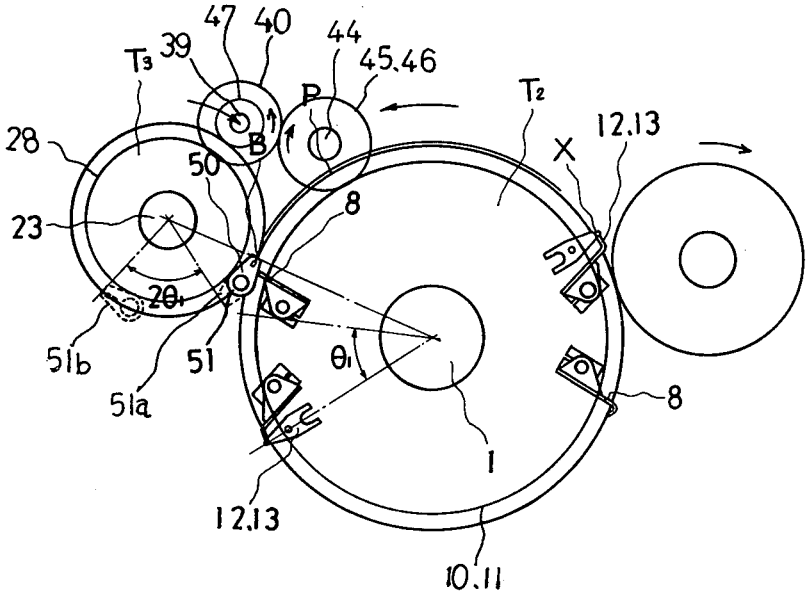
Figure 4:
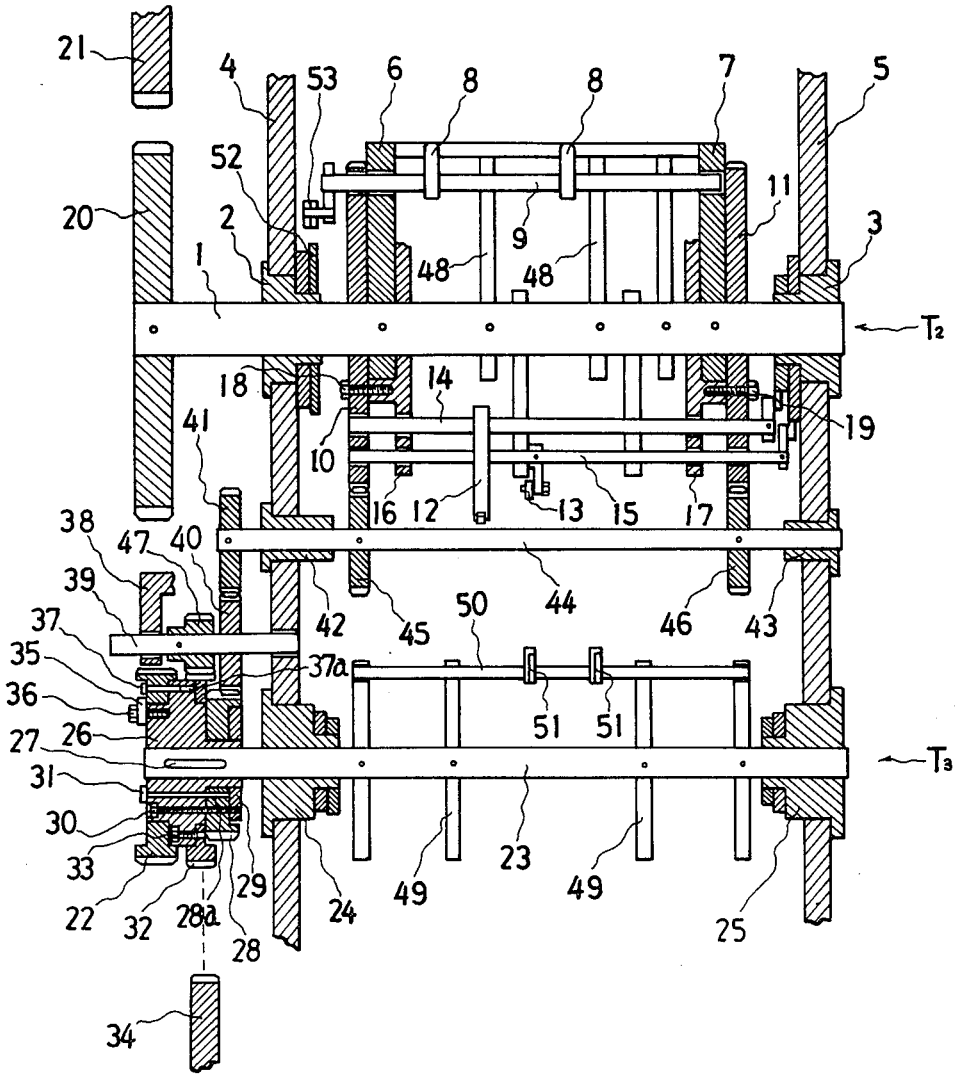
FIG. 4 is an enlarged longitudinal sectional side view of the double-sized drum cylinder and reversing cylinder.
Figure 5:
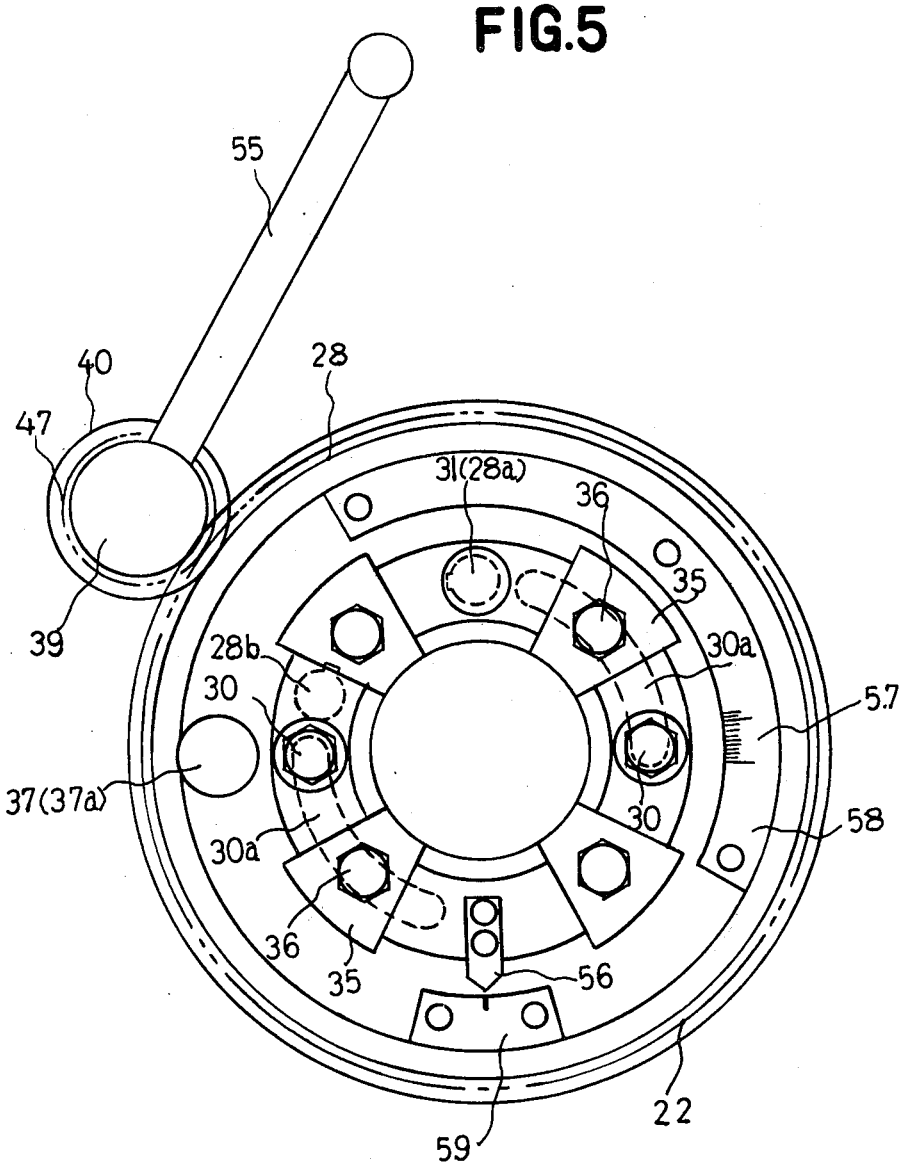
FIG. 5 is an enlarged side view of the flange portion of the reversing cylinder.

Referring first to FIGS. 3, 4 and 5, numeral 1 indicates the main shaft of the double-sized drum cylinder T2, the main shaft 1 being rotatably supported by the bearings 2, 3 in the frames 4,5 on both sides. Also, secured to the main shaft 1 are segment arms 6,7 through which is rotatably supported a shaft 9 on which a plurality of grippers 8 adapted to hold the leading end of the sheet P being printed are mounted. Numerals 10 and 11 refer to adjusting gears having rotatably supported therewith shafts 14, 15 on which a plurality of sheet pressing rolls 12 and sheet pulling rolls 13 constituting the grippers adapted to hold the trailing end of the sheet P are mounted. Secured to the adjusting gears 10, 11 by screws 18, 19 are segment arms 16, 17 to which the trailing end grippers 12,13 are connected, these gears being also connected to the main shaft 1 so as to be rotatable relative thereto. 20 is a driving gear meshed with a series of driving gears 21, 22, and secured to the main shaft 1.

Figure 1:
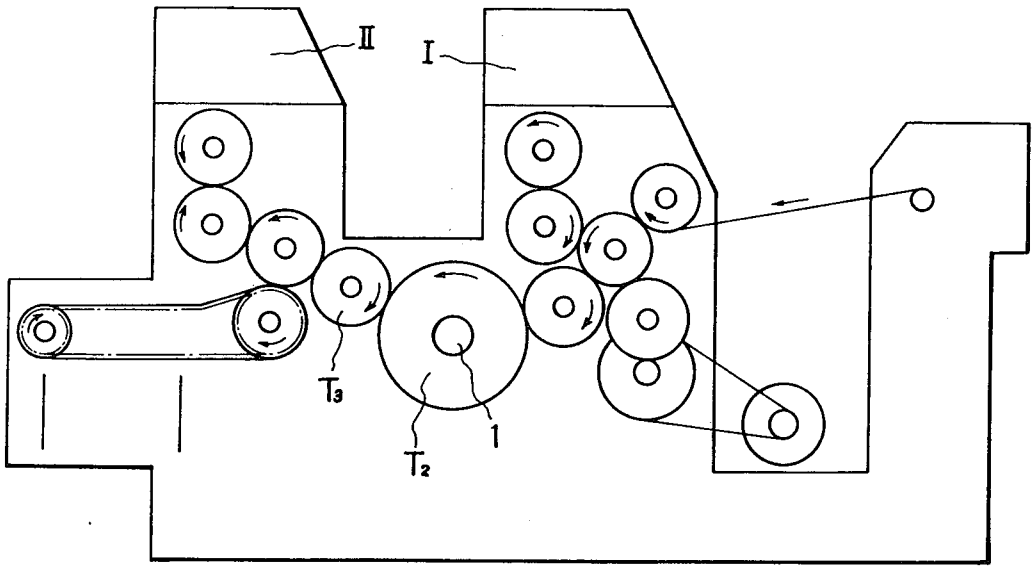
FIG. 1 is a schematic drawing of a two-color one-side/both-side printing press.
Figure 2:
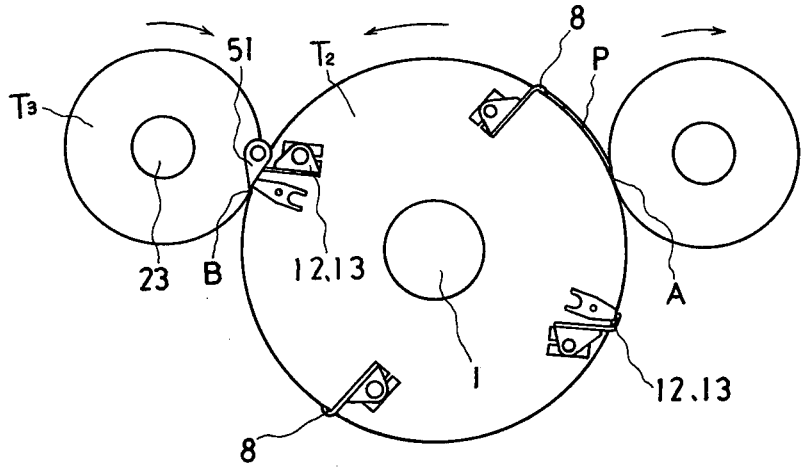
FIGS. 2 and 3 are enlarged sectional side views of a part of the double-sided drum cylinder.

Numeral 23 indicates the main shaft of the reversing cylinder T3, the shaft 23 being rotatably supported by the bearings 24, 25 in the frames 4, 5 at both ends. Secured to the main shaft 23 by a key 27 is a flange 26 to which a main adjusting gear 28 is secured by a positioning pin 31 and a screw 30 through a ring 29. Also secured to the flange 26 by a screw 33 is another driving gear 32 which is meshed with a gear 34 on the impression drum of the second printing unit II (see FIG. 1). Further, the driving gear 22 is secured to the flange 26 by a positioning pin 37 and a screw 36 and through a washer 35.

There is also provided an adjusting shaft 39 rotatably supported by the frame 4 at one end and by an auxiliary bearing 38 at the other end, the adjusting shaft 39 having rotatably mounted thereon an idler gear 40 which is meshed with the main adjusting gear 28 and an intermediate adjusting gear 41, secured to a shaft 44 supported by the bearings 42, 43 in the frame 4,5 at both ends. Mounted on the intermediate adjusting gear shaft 44 are the gears 45, 46 having the same number of teeth as the intermediate adjusting gear 41 and meshed with the adjusting gears 10, 11 respectively, of the double-sized drum cylinder T2. Secured to the adjusting shaft 39 is a pinion 47 meshed with the driving gear 32, 48 and 49 denote sheet guides for the double-sized drum cylinder T2 and reversing cylinder T3, respectively.

Now, the operation of the device will be described. Regarding first the positional relation of the grippers of the respective cylinders in the case of ordinary one-side multi-color printing, the sheet trailing end gripper units 12,13 of the double-sized drum cylinder T2 are positioned spaced apart from each other by a distance slightly greater than the maximal sheet size (see X in FIG. 3). Such positioning can be effected by connecting the driving gear 22 and flange 26 by the positioning pin 37. Each reversing gripper assembly 51 of the reversing cylinder T3 has its shaft 50 biased to the rotating direction of the cylinder T3 as shown in FIG. 3, and the leading end of the sheet P being printed is caught by operation of a separate cam control mechanism at the sheet transfer point B between the double-sized drum cylinder T2 and reversing cylinder T3. Positioning of each reversing gripper assembly 51 of the reversing cylinder T3 is effected by inserting the positioning pin 31 secured to the flange 26 into a socket 28*a* (see FIG. 5) for one-side printing in the principal adjusting gear 28. Each of the sheet leading end grippers 8 of the double-sized drum cylinder T2 is arranged such that it is opened by a separate cam control mechanism 52, 53 at the sheet transfer point B.

The operation for switching this printing mode into both-side printing is as follows. First, the reversing gripper 51 on the reversing cylinder T3 is turned reversely through an angle of about 180° by means of a cam control mechanism (not shown). The position of the reversing gripper 51 which has duly turned reversely is indicated by a reference numeral 51*a* in FIG. 3. Under this condition, when the printing sheet P is to be transferred to the reversing cylinder T3 by holding the trailing end of the sheet by the reversing gripper 51, there is produced an angular shift of $\theta 1$ on the double-sized drum cylinder T2, and it is necessary to move the reversing gripper 51 through an angular distance of $2\theta 1$ on the reversing cylinder T3. In order to move the reversing gripper 51 to the position indicated by reference numeral 51*b* in FIG. 3 by turning the reversing cylinder T3 through an angular distance $2\theta 1$, the following operations are performed. When the fastening screws 36 are loosened to release engagement between the driving gear 22 and flange 26, the washers 35 release clamping on the surface of the driving gear 22 and the positioning pin 37 is removed out of the slot 37*a* for one-side printing formed in the flange 26. Also, for releasing engagement between the main adjusting gear 28 and flange 26, the fastening screws 30 are loosened and the positioning pin 31 is removed out of the slot 28*a* for one-side printing formed in the main adjusting gear 28. Release of said driving gear 22 and main adjusting gear 28 from the flange 26 breaks up any mechanical linkage between the reversing cylinder T3 and the sheet leading end grippers 8 and trailing end grippers 12, 13 on the double-sized drum cylinder T2.

When the handle 55 is turned clockwise under this condition as shown in FIG. 5, the adjusting shaft 39 to which said handle 55 is secured is accordingly turned, causing a corresponding turn of the driving gear 32 through a pinion 47 secured to said adjusting shaft 39. As said driving gear 32 is secured to the flange 26, the cylinder T3 is also forced to turn. Thus, the cylinder T3 is turned through and angular distance $2\theta 1$ by operating the handle 55. The position of the reversing gripper 51 on the reversing cylinder T3 under this condition is shown by a reference numeral 51*b* in FIG. 3.

When the handle 55 is turned, both sheet leading end grippers 8 and trailing end grippers 12, 13 on the double-sized cylinder T2 stay still. It is to be noted that the elongated slots 30*a* are provided in the main adjusting gear 28 in correspondence to the locus of movement of the fastening screws 30 to prevent the sheet trailing end grippers 12, 13 from turning with the fastening screws 30 when the flange 26 is turned. The positioning pin 31 which has turned through an angular distance of $2\theta 1$ with the flange 26 fits into the hole 28*b* for both-side printing in the main adjusting gear 28, whereby the flange 26 is joined to the main adjusting gear 28.

For adjusting the reversing gripper 51 and sheet t trailing end grippers 12, 13 to the length of the printing sheet P in the circumferential direction, the adjusting shaft 39 is further turned through the handle 55 to let the driving gear 32 turn through the pinion 47 secured to said adjusting shaft 39, causing a corresponding turn of the flange 26 which is secured to said driving gear 32. The driving gear 22 stays still as it remains separate from the flange 26. After completing the setting to the sheet length by means of a scale 57 provided on the driving gear 22 and a pointer 56 provided on the flange 26, the fastening screws 30 are tightened. When the flange 26 is turned through the driving gear 32, the main adjusting gear 28 is also urged to turn accordingly through the positioning pin 31, causing the adjusting gears 10, 11 to turn with the segment arms 16, 17 on the main shaft 1 through a train of gears 40, 41, 45, 46 meshed with said main adjusting gear 28. This forces the sheet trailing end grippers 12, 13 to move toward the leading end grippers 8 and stop at a fixed position. In this case, the positioning pin 37 is kept away from the hole 37*a* for one-side printing in the flange 26 and the relative positions of the flange 26 and driving gear 22 can be decided optionally in accordance with the length of the printing sheet P in the circumferential direction. Although the sheet trailing end grippers 12, 13 are disposed on the main shaft 1, they won't be driven by the main shaft 1.

As the fastening screws 36 are tightened, the driving gear 22 is fixed to the flange 26 through the washers 35. Accordingly, the rotation of the double-sized cylinder T2 transmitted through the driving gear 20 drives the reversing gripper 51 through the driving gear 22 until said reversing gripper 51 comes to coincide withthe sheet trailing end grippers 12, 13 at the printing sheet transfer point B, allowing transfer of the printing sheet P by a cam control mechanism.

The sheet leading end gripper 8 does not release the printing sheet P at the sheet transfer point B; said sheet P is released by the cam control mechanisms 52, 53 after the sheet P has passed said transfer point B and was received by the reversing gripper 51. It should be noted that transfer of the printing sheet P can not be accomplished unless the reversing gripper 51 and the sheet trailing end grippers 12, 13 are same in the amount of rotation. For this reason, the gear ratio of the main adjusting gear 28 to the adjusting gears 10, 11 is set at 1:2 same as the gear ratio of the driving gear 22 to gear 20. Thus, the sheet trailing end grippers 12, 13 are turned in the same direction and at the same speed as the sheet leading end grippers 8 along with the adjusting gears 10, 11 and segment arms 16, 17 by the driving force transmitted from the main adjusting gear 28.

Now, the operations for switching from both-side printing to one-side printing are described. First, the reversing gripper 51 on the reversing cylinder T3 is turned reversely by about 180° by a cam control mechanism (not shown). Then the fastening screws 36, 30 are loosened to remove the positioning pin 31 from the hole 28*b* for both-side printing. Thereafter, the adjusting shaft 39 is turned counterclockwise by the handle 55 to let the driving gear 32 turn accordingly through a pinion 47 secured to said adjusting shaft 39, causing a corresponding turn of the flange 26 secured to the driving gear 32, also allowing the positioning pin 31 and fastening screws 30 to turn with said flange 26. In this case, since the flange 26, driving gear 22 and main adjusting gear 28 are disengaged from each other, both the sheet leading end grippers 8 and trailing end grippers 12, 13 stay stationary and the reversing gripper 51 alone is allowed to move to the position indicated by reference numeral 51 in FIG. 3.

As the flange 26 is further turned, each fastening screw 30 comes to abut against the end of the associated alongated slot 30*a* in the main adjusting gear 28, whereupon the main adjusting gear 28 is forced to turn through the fastening screws 30, causing the sheet trailing end grippers 12, 13 to turn with the reversing gripper 51 through a train of gears 40, 41, 45, 46. During this operation, the driving gear 22 is not turned, so that the sheet leading end grippers 8, which are driven by said driving gear 22 through the driving gear 20, stay still. Also, since the driving gear 22 keeps still, there is produced a relative movement between the flange 26 and said driving gear, so the pointer 56 on the flange 26 is set to a marking 59 for one-side printing given on the driving gear 22 and at this position the positioning pin 37 is fitted into the hole 37*a* for one-side printing formed in the flange 26 while the positioning pin 31 is fitted into the hole 28*a* for one-side printing in the main adjusting gear 28, and then the fastening screws 36, 30 are tightened to complete the switching operation.

Having the above-said structural arrangements, this embodiment according to the invention can produce the following effects.

(1) The regulated positions of the reversing grippers 51 of the reversing cylinder T3 relative to the sheet leading and trailing end grippers 8, 12 of the double-sized drum cylinder in case of switching from one-side to both-side printing, or vice versa, as well as the predetermined positions of the trailing end grippers 12, 13 of the double-sized drum cylinder T2 at the time of one-side printing can be surely and correctly set by the positioning pins 31, 37. Also, inadvertent failure to fasten the fastening screw 30 does not lead to any serious trouble. Thus, the operational safety of the device is secured.

(2) Since the reversing grippers 51 and the sheet trailing end grippers 12, 13 of the double-sized drum cylinder T2 are connected through a series of gears 28, 40, 41, 45, 46 and adjusting gears 10, 11, there takes place no derangement in the relative positions of both these grippers even if a misoperation is committed at the time of adjustment corresponding to a change in the sheet size. In other words, since the gear ratio of the principal adjusting gear 28 and the adjusting gears 10, 11 is set at 1:2 which is the same as the gear ratio of the driving gears 32, 20, the sheet trailing end grippers 12, 13 of the double-sized drum cylinder T2 turn at the same speed as the sheet leading end grippers 8 and hence no divergence is caused in the movements of these grippers. Also, because of driving on both sides, there takes place no derangement and smooth rotation is ensured.

(3) Since the operations for switching from one-side printing to both-side printing, or vice versa, are concentrated to the driving gear 22 and its flange 26, the operator can perform his work at one position with no need of repeating standing and sitting for making the operational adjustment. Also, only two types of tools (fastening wrench and manual handle) are required for the operation and all the operations involved are consistent.

Attention is drawn to co-pending application Ser. No. 255,155, filed Apr. 17, 1981 which describes in more detail and claims the trailing end grippers.

I claim:

1. An adjusting device for sheet reversing in a sheet-fed rotary press comprising a drive shaft, a reversing cylinder which is driven by the drive shaft and carries a plurality of sheet grippers, a rotary drum carrying a plurality of leading-end grippers, and a rotary assembly carrying a plurality of trailing-end grippers, which is concentric with said drum, wherein the improvement comprises a flange fixed to said drive shaft, a first drive gear fixed to said flange, a second drive gear which is adjustably attached to said flange and has a driving connection with said rotary assembly, a third drive gear which is adjustably attached to said flange and has a driving connection with said rotary drum, and means for manually rotating said reversing drive cylinder through said first drive gear, for selectively adjusting the angular position of attachment of the second and third gears to said flange.

2. An adjusting device as claimed in claim 1 wherein the second drive gear is rotationally adjustable with respect to the flange from one position for one side printing to another position for double-side printing, two sockets being provided in the second drive gear for engagement by a pin engageable in the flange, one socket locating the one position and the other socket locating the other position and locking means being provided for locking the second drive gear in either position.

3. An adjusting device as claimed in claim 1 or claim 2 wherein the third drive gear is rotationally adjustable with respect to the flange from a position for maximum sheet length and one side printing to a variable position for varying sheet length and double-side printing, one socket-locating the maximum sheet length position-being provided in the third drive gear for engagement by a pin engageable in the flange, a scale being provided for locating the variable position and locking means being provided for locking the third drive gear in position.

4. An adjusting device as claimed in claim 1 or claim 3 wherein the assembly carrying the trailing end grippers is supported at both sides of the drum, and drive gear means drivingly connected to the second drive gear is provided for driving the said assembly at both sides of the drum cylinder.

* * * * *